US007631580B2

(12) United States Patent
Lu et al.

(10) Patent No.: US 7,631,580 B2
(45) Date of Patent: Dec. 15, 2009

(54) WRENCH FOR TIGHTENING PIPE NUTS

(75) Inventors: Jan Lu, Troy, MI (US); Michael M. Arvaneh, Grand Blanc, MI (US); Klaus Philipps, Mommenheim (DE)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/938,952

(22) Filed: Nov. 13, 2007

(65) Prior Publication Data

US 2009/0120244 A1 May 14, 2009

(51) Int. Cl.
*B25B 21/00* (2006.01)

(52) U.S. Cl. ..... 81/57.14; 81/56

(58) Field of Classification Search ..... 81/55, 81/57.14, 57.3

See application file for complete search history.

(56) References Cited

U.S. PATENT DOCUMENTS 5,460,062 A * 10/1995 Wilson, Jr. ..... 81/56
5,697,266 A * 12/1997 Wilson, Jr. ..... 81/57.14
6,935,209 B2 * 8/2005 Lantow et al. ..... 81/55
7,287,447 B2 * 10/2007 Pettit, Jr. ..... 81/56
2004/0250658 A1 * 12/2004 Liao ..... 81/58.2

* cited by examiner

*Primary Examiner*—D. S Meislin

(57) ABSTRACT

A wrench for tightening threaded male and female pipe nuts includes a wrench gear rotatable within a housing and having a nut slot so that the wrench gear can be engaged upon one of the nuts. A pair of pinion drive gears engage with gear teeth of the wrench gear at spaced apart locations on the periphery so that at least one of the pinion drive gears is engaged with the wrench gear at all times during rotation of the wrench gear to tighten the one nut. A nut holding plate has a nut slot and is mounted on the housing by a pin and slot arrangement so that the nut holding plate can shift to enable the nut holding plate to be engaged upon the other nut and hold the other nut stationary while the wrench gear is rotated to tighten the one nut.

7 Claims, 4 Drawing Sheets

WRENCH FOR TIGHTENING PIPE NUTS

FIELD OF THE INVENTION

The present invention relates to tightening of hex-shaped male and female threaded nuts to connect a pipe, and more particularly provides a power wrench for rotating one of the nuts and a nut holding plate for holding the other nut during the rotation of the one nut.

BACKGROUND OF THE INVENTION

It is known to connect together a first pipe and a second pipe via threaded male and female pipe connecting nuts. Both of the nuts can be rotated, or one nut can be rotated while holding the other nut stationary. It would be desirable to provide a new and improved wrench for rotating the one nut while the wrench also holds the other nut stationary.

SUMMARY OF THE INVENTION

A wrench for tightening threaded male and female pipe nuts includes a wrench gear rotatable within a housing and having gear teeth on the periphery thereof. A nut slot is provided in the periphery so that the wrench gear can be engaged upon one of the nuts. A pair of pinion drive gears is rotatably mounted on the housing and engaging with the gear teeth of the wrench gear at spaced apart locations on the periphery so that at least one of the pinion drive gears is engaged with the wrench gear at all times during rotation of the wrench gear to tighten the one nut. A nut holding plate has a nut slot so that the nut holding plate can be engaged upon the other of the nuts. The nut holding plate is mounted on the housing by a pin and slot arrangement so that the nut holding plate can shift relative to the housing and the wrench gear to enable the nut holding plate to be engaged upon the other nut irrespective of the relative rotational position of the one nut and the other nut when the wrench gear and the nut holding plate are installed onto the nuts.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is exemplary in nature and is not intended to limit the invention, its application, or uses.

Figure 1:
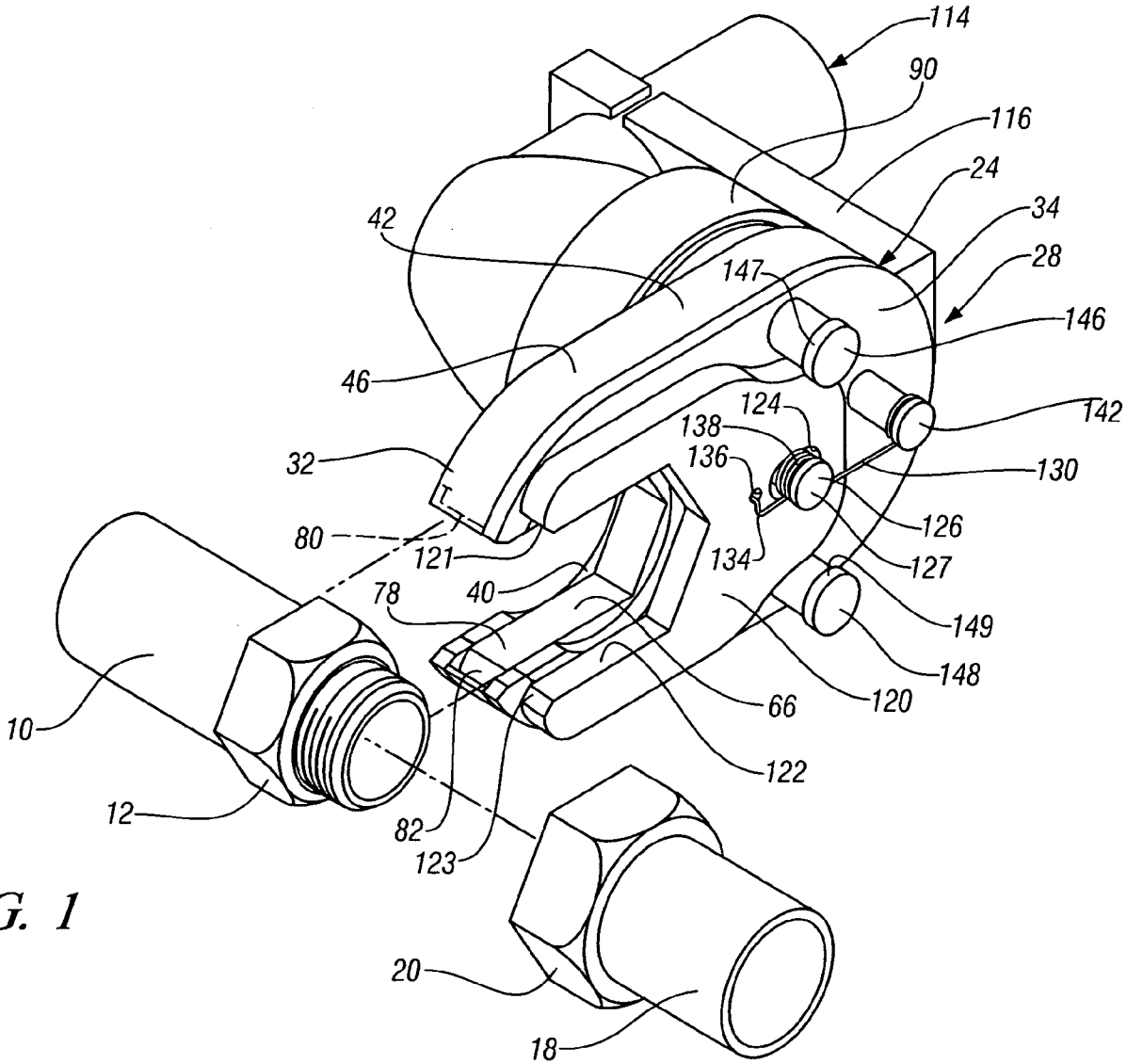
FIG. 1 is a perspective view of first and second pipes having threaded male and female pipe nuts for joining the pipes together, and a wrench according to the invention.

Referring to FIG. 1, a pipe 10 has a threaded male nut 12 that is rotatable on the end of the pipe 10. The pipe 10 has a flange or a sealing ring that engages with the male nut 12 so that the nut 12 is retained on the end of the pipe 10 but permitted to rotate about the pipe 10. The outside of the nut 12 is hex-shaped.

Pipe 18 has a threaded female nut 20 that is rotatable on the end of the pipe 18. The pipe 18 has a flange or a sealing ring that engages with the female nut 20 so that the nut 20 is retained on the end of the pipe 18 but permitted to rotate. The outside of the nut 20 is hex-shaped.

Figure 2:
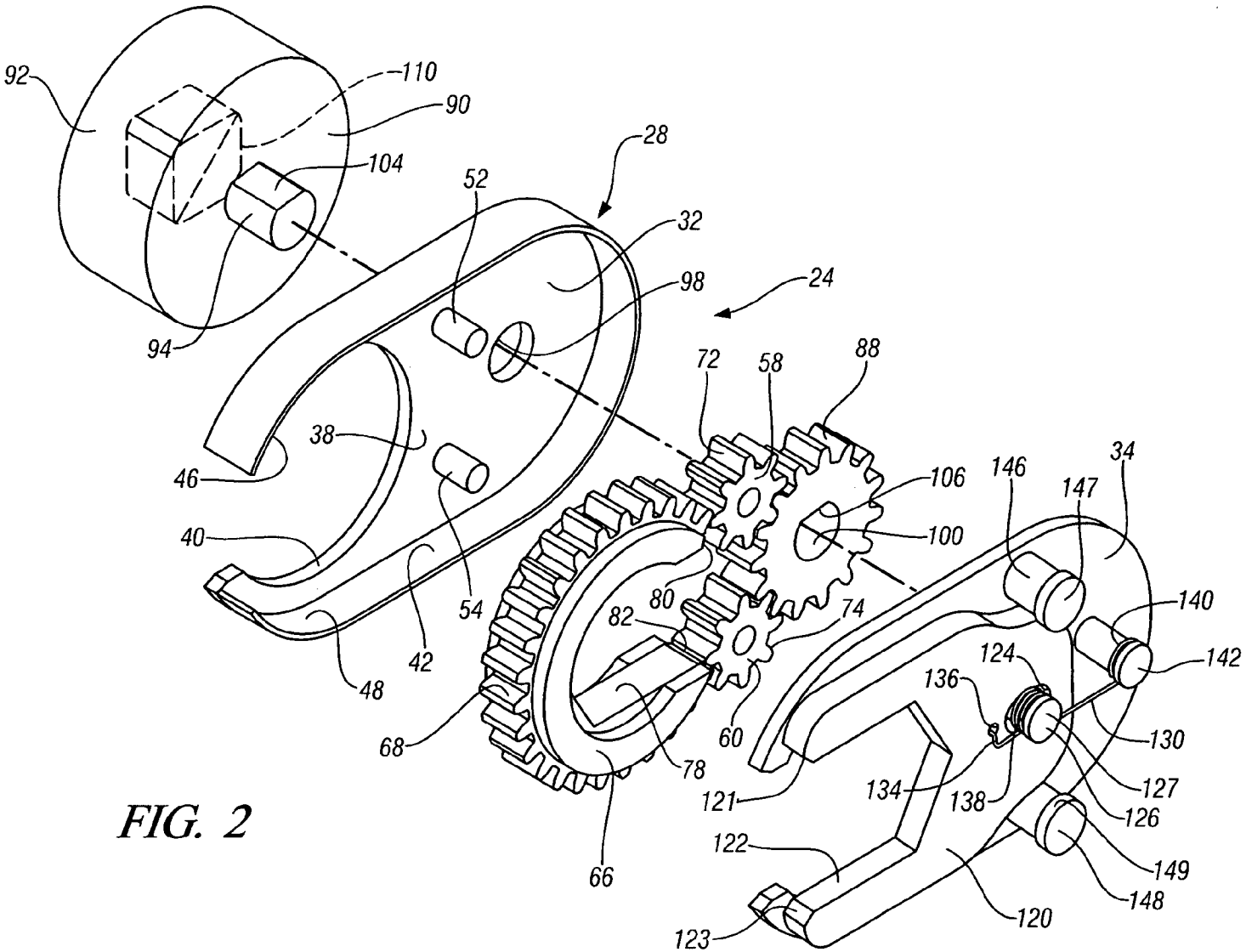
FIG. 2 is an exploded view showing the components of the wrench.

A power wrench, FIG. 1, generally indicated at 24, is provided for tightening the male nut 12 and while holding the female nut 20 stationary. FIG. 2 is an exploded perspective view of the wrench 24. Wrench 24 includes housing, generally indicated at 28, having a housing base 32 and a housing cover 34. Housing base 32 includes a base wall 38 having a cutout 40. A side wall 42 projects from the base wall 38 and includes curved or arcuate wall portions 46 and 48 that surround a part of the cutout 40. A pair of pivot pins 52 and 54 project from the base wall 38.

Pinion drive gears 58 and 60 are seated respectively on the pivot pins 52 and 54. A wrench gear 66 has peripheral gear teeth 68 that slide on the curved wall portions 46 and 48 of the housing base wall 38 and also mesh with teeth 72 and 74 of the pinion drive gears 58 and 60 so that the wrench gear 66 is rotatably captured by the pinion drive gears 58 and 60 and the curved wall portions 46 and 48. The wrench gear 66 has an open end wrench slot 78 that is shaped and dimensioned to fit onto the hex shape of the threaded male nut 12. Chamfers 80 and 82 are provided on the wrench gear 66 at the entry of the wrench slot 78. As seen in FIG. 2, the pinion drive gears 58 and 60 are positioned so that at least one of the pinion drive gears 58 and 60 will always be meshing with the peripheral teeth 68 of the wrench gear 66 during rotation of the wrench gear 66.

A drive gear 86 has peripheral teeth 88 that mesh with the teeth 72 and 74 of the pinion drive gears 58 and 60. A drive shaft 90 is provided for driving the drive gear 86 and includes a body 92 located outside the housing 28 and a shaft 94 that extends through a hole 98 in the base wall 38 and into a bore 100 in the drive gear 86. The shaft 94 has a flat 104 that engages with a mating flat 106 of the bore 100 so that the drive shaft 90 is keyed to the drive gear 86. The drive shaft 90 has a square socket 110 that is coaxial with the shaft 94. A conventional power driver, either pneumatic or electrical, generally indicated at 114, FIG. 1, has a square output shaft that is seated in the square socket 110, FIG. 2, of the drive shaft 90. A mounting bracket 116 attaches the power driver 114 to the housing base 28.

Energizing the power driver 114 will rotate the drive shaft 90, which rotates drive gear 86, which rotates the pinion gears 58, which rotate the wrench gear 78 to tighten the male nut 12.

Figure 4:
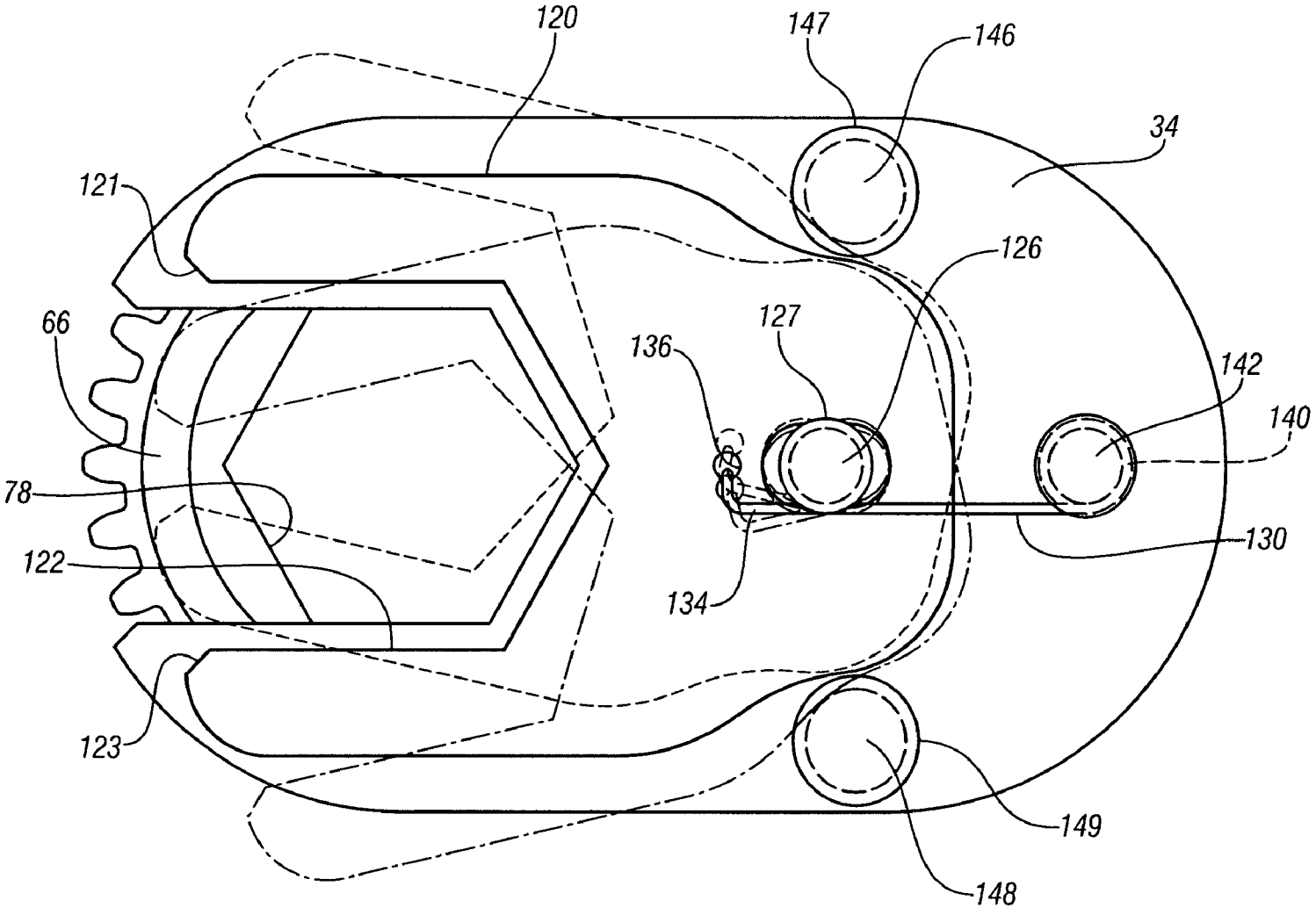
FIG. 4 is a side elevation of the wrench showing a nut holding plate that fits onto one of the nuts to hold that nut stationary while the other nut is rotated.

A nut holding plate 120 is provided for holding the nut 20 while the nut 12 is rotated. The nut holding plate 120 has a nut holding slot 122 and is mounted on the housing cover 34 and lays along side the housing cover 34. Chamfers 21 and 123 are provided on the nut holding plate 120 at the entry of the nut holding slot 122. The nut holding plate 120 is connected to the housing cover 34 by a slot 124 of the nut holding plate 120 that is seated on a pin 126 projecting from the housing cover 34. The pin 126 has a head 127 wider than slot 124 so that nut holding plate 120 is held against movement away from the housing cover 34. A spring 130 is provided to urge the nut holding plate 120 to a centered position in which the slot 124 of the nut holding plate 120 is aligned with the wrench slot 78 of the wrench gear 66. The spring 130 has one end 134 that is seated in a hole 136 of the nut holding plate 120, a central portion 138 that wraps around the pin 126 and is also captured beneath the head 127 of pin 126, and an end 140 that is anchored on a spring anchor pin 142 mounted on the housing cover 34. As seen in FIG. 4, the spring 130 is yieldable to the phantom line indicated positions to allow the nut holding plate 120 to shift bodily on the housing cover 34 as shown in the phantom lines of FIG. 4 so that the nut holding slot 122 of the nut holding plate 120 can be slipped onto the nut 20 even when the nut 20 and the nut 12 are out of rotational registry with one another. The shifting movement of the nut holding plate 120 relative to the housing cover 34 is limited by stop pins 146 and 148 that are mounted on the housing cover 34 on opposite sides of the nut holding plate 120 so that the nut holding plate 120 will engage with the stop pins as shown in FIG. 4.

Figure 3:
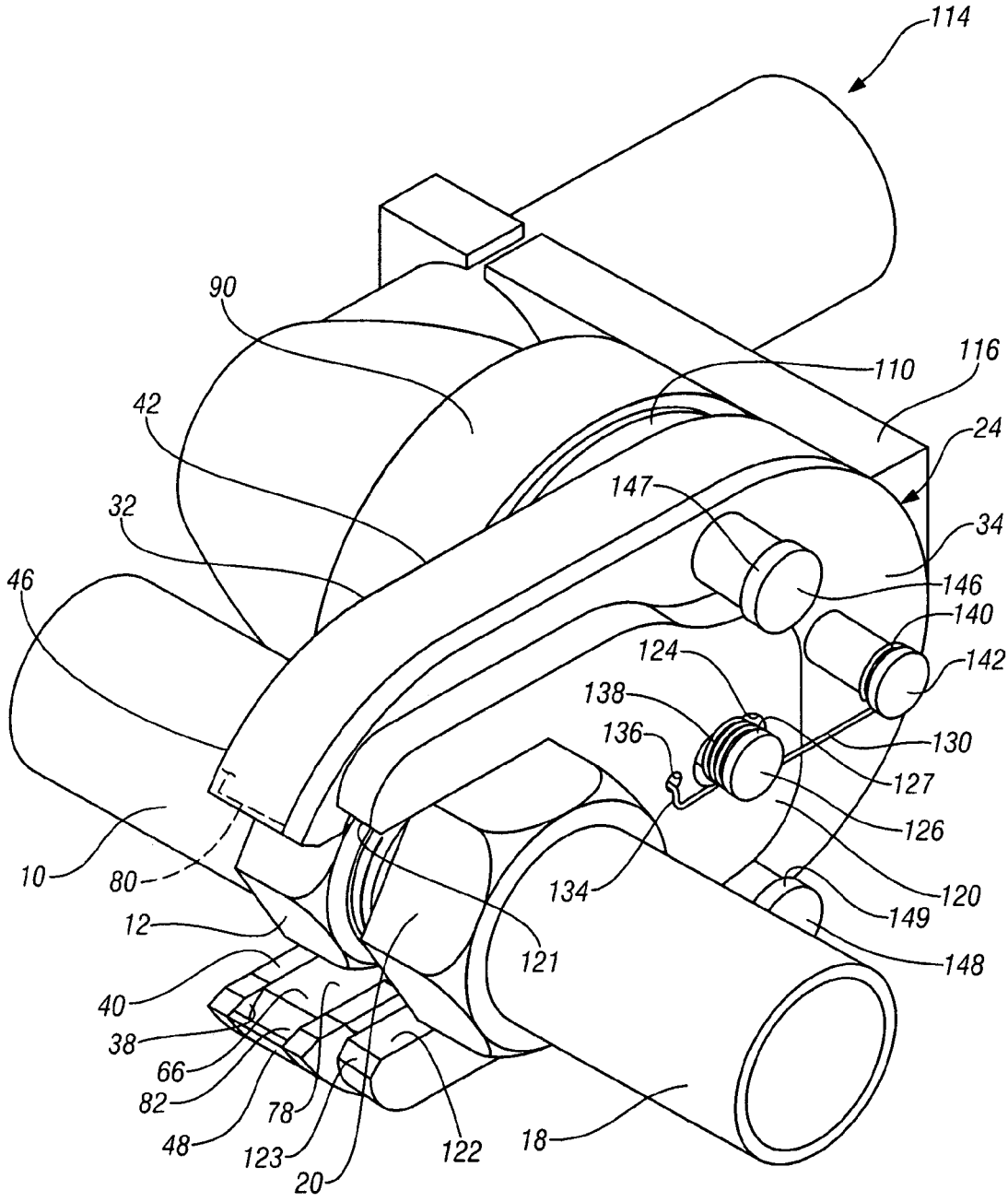
FIG. 3 shows the pipes of FIG. 1 having been loosely threaded together and the wrench applied to the pipe nuts in readiness for tightening the nuts.

Thus, in operation, as seen in FIG. 3, the nuts 12 and 20 are finger tightened together to get the threaded connection started. Then the wrench 24 is applied to the nuts by fitting the slot 78 of the wrench gear 66 over the nut 12 and fitting the slot 124 of the nut holding plate 120 over the nut 20. The power driver 114 is then energized to rotate the wrench gear 66 through several full rotations until the nut 12 is fully tightened on the nut 20. Suitable controls are provided in the mechanism to monitor the rotations of the wrench gear 66 and, at the end of the tightening, to return the wrench gear 66 to the rotary position of FIGS. 1 and 4 where the open end slot 78 permits the wrench gear 66 to be removed from the nuts 12 and 20.

The foregoing description of the invention is merely exemplary in nature and, thus, variations thereof are intended to be within the scope of the invention. It will be understood that the wrench 24 can be used in various types of nut-to-nut pipe connections. For example, both the nuts 12 and 20 can be rotatable on the pipes as described above, and the nut holding plate 120 will hold the nut 20 against rotation. Or the nut 20 can be mounted on the pipe 18 in a manner that the nut 20 is fixed to the pipe 18 and does not rotate. Accordingly, if the pipe 18 is of thin wall material, the nut holding plate 120 will hold the nut 20 so that the torque applied by the wrench gear 66 will not twist the thin wall material of the pipe 18. Furthermore, although the drawing herein shows a rotating nut 12 that is a male nut, the nut to be rotated by the wrench gear 68 can be a female nut.

What is claimed is:

1. A wrench for tightening threaded male and female pipe fitting nuts comprising:

a housing;

a wrench gear rotatable within the housing and having gear teeth on the periphery thereof and a nut slot provided in the periphery so that the wrench gear can be engaged upon one of the nuts;

a pair of pinion drive gears rotateably mounted on the housing and engaging with the gear teeth of the wrench gear at spaced apart locations on the periphery so that at least one of the pinion drive gears is engaged with the wrench gear at all times during rotation of the wrench gear to tighten the one nut;

a nut holding plate having a nut holding slot so that the nut holding plate can be engaged upon the other of the nuts, said nut holding plate being mounted on the housing by a pin and slot arrangement, the nut holding plate being movable in the plane in which a surface of the housing lies such that a substantial portion of the nut holding plate remains in contact with the surface of the housing during pivotal movement of the nut holding plate and is held upon the housing against transverse movement toward and away from the housing and yet can pivotally shift relative to the housing and the wrench gear to enable the nut holding plate to be engaged upon the other nut irrespective of the relative rotational position of the one nut and the other nut when the wrench gear and the nut holding plate are installed onto the nuts;

a spring acting between the housing and the nut holding plate to pivotally urge the nut holding plate to a centered position in which the nut holding slot of the nut holding plate is aligned with the nut slot of the wrench gear, and said spring yielding to permit the pivotal shifting of the nut holding plate about the pivot to align the slot of the nut holding plate with the other of the nuts irrespective of the nuts being at differing rotational positions;

and first and second stops provided on the housing on opposite sides of the nut holding plate and engageable by the nut holding plate to and limit the pivotal shifting movement of the nut holding plate relative to the housing and thereby hold the other nut while the wrench gear is rotating to tighten the one nut relative the other nut.

2. The wrench of claim 1 further comprising either or both of the wrench gear and the nut holding plate having a chamfer at the entry to the slot thereof.

3. The wrench of claim 1 further comprising a drive gear having teeth meshing with the pinion drive gears and a power driver coupled with the drive gear.

4. The wrench of claim 1 further comprising said power driver having square output shaft and the drive gear having a square socket for receiving the square output shaft.

5. The wrench of claim 1 further comprising said housing having a plurality of housing portions attached together.

6. The wrench of claim 1 further comprising said housing having a arcuate wall engaged by a portion of the teeth on the periphery of the wrench gear and cooperating with the pinion drive gears to support the wrench gear within the housing for rotation.

7. A wrench for tightening threaded male and female pipe fitting nuts comprising:

a housing, having a housing base having a cutout and a pair of actuate wall portions, and a housing cover;

a wrench gear rotatable within the housing and having gear teeth on the periphery thereof that bear upon the arcuate wall portions of the housing base and a chamfered nut slot provided in the periphery so that the wrench gear can be engaged upon one of the nuts;

a pair of pinion drive gears rotateably mounted on the housing and engaging with the gear teeth of the wrench gear at spaced apart locations on the periphery so that at least one of the pinion drive gears is engaged with the wrench gear at all times during rotation of the wrench gear to tighten the one nut and the teeth of the wrench gear are also engaged with the arcuate wall portions;

a drive gear rotateably mounted on the housing and having teeth meshing with the pinion drive gears, said drive gear having a square socket thereon concentric with the axis of rotation of the drive gear;

a power driver mounted on the housing and having a square output shall inserted into the square socket of the drive gear to power the rotation of the wrench gear to tighten the one nut;

a nut holding plate having a chamfered nut holding slot so that the nut holding plate can be engaged upon the other of the nuts, said nut holding plate being mounted one the housing by a pin and slot arrangement, the nut holding plate being movable in the plane in which a surface of the housing lies such that a substantial portion of the nut holding plate remains in contact with the surface of the housing during pivotal movement of the nut holding plate and is held upon the housing against transverse movement toward and away from the housing and yet can pivotally shift relative to the housing and the wrench gear to enable the nut holding plate to be engaged upon the other nut irrespective of the relative rotational position of the one nut and the other nut when the wrench gear and the nut holding plate are installed onto the nuts;

a spring acting between the housing and the nut holding plate to establish the nut holding plate at a normal position relative to the housing, said spring acting to pivotally urge the nut holding plate to a centered position in which the nut holding slot of the nut holding plate is aligned with the nut slot of the wrench gear, and said spring yielding to permit the pivotal shifting of the nut holding plate about the pivot to align the slot of the nut holding plate with the other of the nuts irrespective of the nuts being at differing rotational positions;

and first and second stops provided on the housing on opposite sides of the nut holding plate and engageable by the nut holding plate to stop and limit movement of the nut holding plate relative to the housing and thereby hold the other nut while the wrench gear is rotating to tighten the one nut relative the other nut.

* * * * *